United States Patent [19]

Fann et al.

[11] Patent Number: 4,639,025

[45] Date of Patent: Jan. 27, 1987

[54] ADJUSTABLE DEAD BOLT ASSEMBLY

[75] Inventors: Yaw S. Fann; Rong-Faa Wu, both of Chia-Yi, Taiwan

[73] Assignee: Tong Lung Metal Industry Co., Ltd., Chia-Yi, Taiwan

[21] Appl. No.: 840,597

[22] Filed: Mar. 17, 1986

[51] Int. Cl.[4] ..... E05C 1/06

[52] U.S. Cl. ..... 292/337; 292/1; 292/173; 292/DIG. 60

[58] Field of Search ..... 292/1, 173, 337, DIG. 60, 292/DIG. 44

[56] References Cited

U.S. PATENT DOCUMENTS 4,593,542 6/1986 Rotondi et al. ..... 292/337 X 4,602,490 7/1986 Glass et al. ..... 70/134

*Primary Examiner*—Richard E. Moore

*Attorney, Agent, or Firm*—Ladas & Parry

[57] ABSTRACT

An improvement for a dead bolt assembly having a dead bolt mounted movably in a bolt casing and a crank plate mounted in an extension housing at the rear side of the bolt casing to move the dead bolt upon actuation of a lock, comprises an adjustable bolt extension member which has a fixed plate member and an extensible channel member pivoted to the fixed plate member, and a crank plate mounting means which is mounted movably in the extension housing to hold the crank plate in a movable position so that the crank plate can be kept in a cooperative relationship with the extensible member.

8 Claims, 5 Drawing Figures

ADJUSTABLE DEAD BOLT ASSEMBLY

BACKGROUND OF THE INVENTION

This invention relates to a dead bolt for a cylinder lock and particularly to an adjustable dead bolt assembly which has an adjustable bolt extension member to be connected to a cylinder lock.

Typically the bolt, which can be put into a locking position and an unlocking position by the actuation of a cylinder lock, is housed in a bolt casing capable of being mounted in a door and is incorporated with a crank plate capable of being connected to the cylinder lock. Generally, the bolts presently available are of two sizes, one being 2⅜ inches or 60 mm and the other being 2¾ inches or 70 mm, and their lengths are not adjustable. In buying a bolt, the user must get a bolt of a length which suits the specification of the door. Sometimes, inconvenience may cause to the user if he buys a bolt of the wrong specification. Therefore, an improvement is desirable to obtain a bolt of adjustable length.

SUMMARY OF THE INVENTION

An object of the invention is to provide a novel, easily adjustable bolt assembly for a cylinder lock.

Another object of the invention is to provide a dead bolt assembly which can be adjusted to have a length of 60 mm or 70 mm.

The invention provides a dead bolt assembly including an adjustable bolt extension member connected to the rear end of a bolt and housed in an extension housing of the bolt casing. The bolt extension member includes a fixed member fixed to the bolt and an extensible member pivoted movably to the fixed member and cooperating with an actuating crank plate. The extensible member has a longitudinal guide aperture with a front and a rear engaging portion turned at an angle to the longitudinal aperture, and a pivot pin passes through the longitudinal guide aperture for pivoting the fixed member and the extensible member. The extensible member can move between an extended position in which the pivot pin is engaged in the front engaging portion and a retrected position in which the pivot pin is engaged in the rear engaging portion.

A crank plate holding means is disposed in the extension housing and can be positioned adjustably in the extension housing in a first position and a second position corresponding to the retracted position and the extended position of the extensible member so that the crank plate can always be kept in a cooperative relationship with the extensible member.

There is a means mounted in the extension housing for disengaging the pivot pin from the front engaging portion or the rear engaging portion. Said means includes a disengaging transverse pin which can be moved manually upward and downward to move the pivot pin to a released position relative to the front or rear engaging portion of the guide aperture.

In one aspect of the invention, the extension housing has a U-shaped cross-section, including two first parallel panels, and the crank plate holding means includes two second parallel panels and a rear panel interconnecting the second parallel panels. The second parallel panels sandwich the crank plate in a movable position, and have front notches and rear notches at the top edges thereof to engage with the disengaging pin. The transverse disengaging pin engages with the rear notches when the crank plate holding means is in the first position and with the front notches when the crank plate holding means is in the second position. When it is lifted, it disengages from the front notches or the rear notches to allow the crank plate holding means to move.

The present exemplary preferred embodiment will be described in detail with reference to the following drawings.

DETAILED DESCRIPTION OF THE PREFERRED EMBODIMENT

Figure 1:
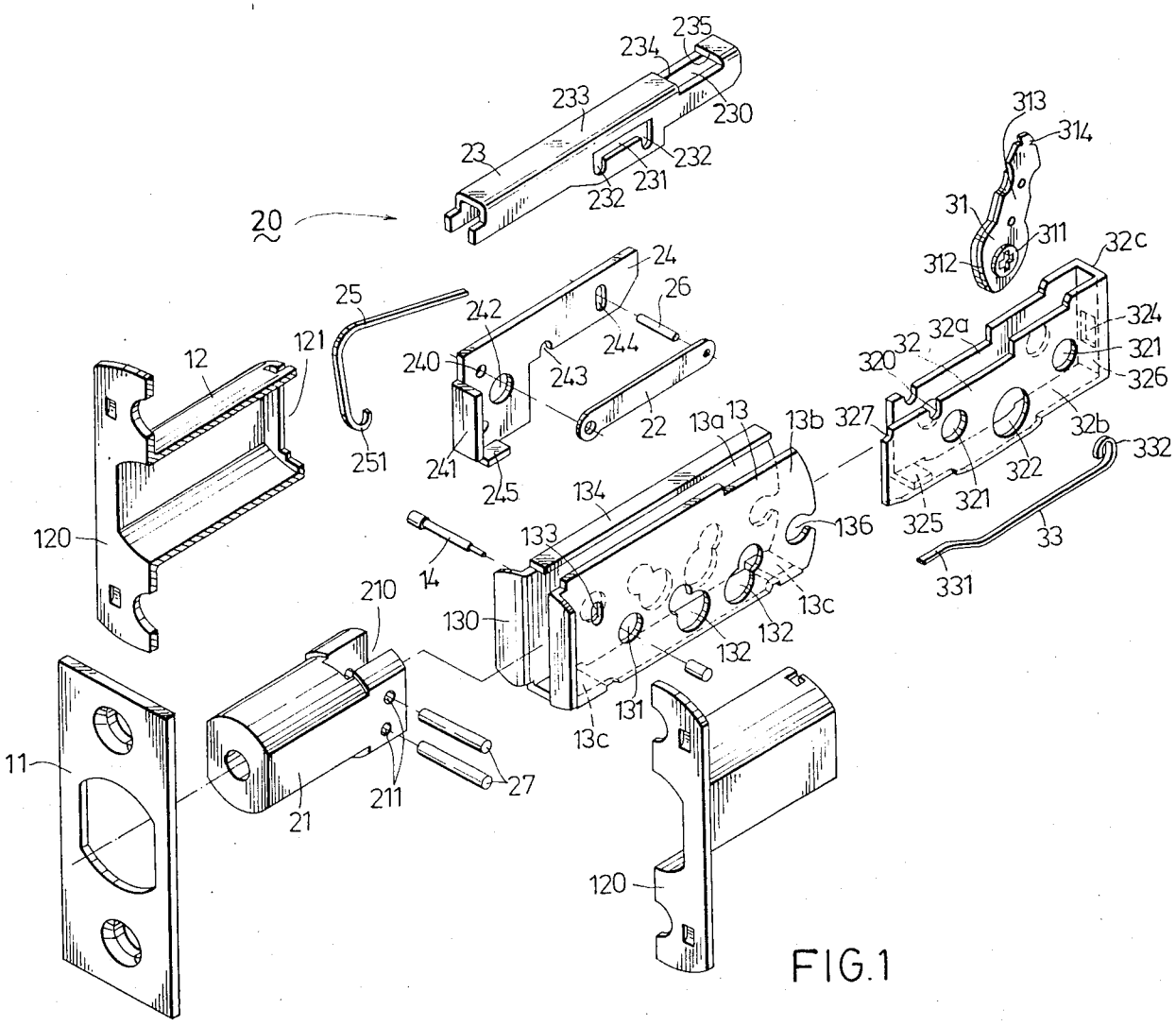
FIG. 1 is an exploded view of a dead bolt assembly according to the present invention.
Figure 2:
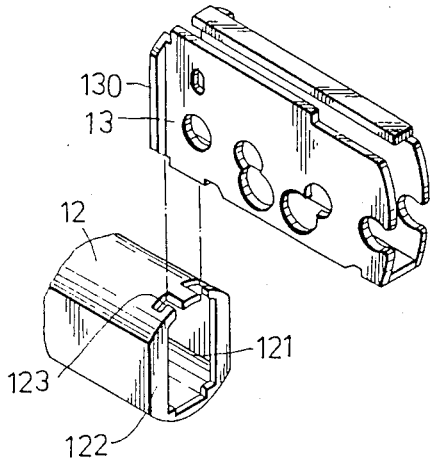
FIG. 2 is an exploded view showing the bolt casing and the extension housing.

Referring to FIGS. 1 and 2, a bolt assembly according to the invention includes a bolt casing 12 housing a bolt 21, an extension housing 13 connected to the bolt casing 12, an adjustable bolt extension member 20 connected to the bolt 21, and an actuating crank plate 31, which engages with the bolt extension member 20, mounted in a crank plate holding means 32.

The bolt casing 12 has a front flange 120 secured to a mounting plate 11. At the rear side of the casing 12 is an opening 121. The extension housing 13 is secured to the rear side of the bolt casing 12, which has two parallel panels **13*a* and 13*b* spaced apart from each other, and two base webs 13*c*, which are spaced apart from one another and which interconnect panels 13*a* and 13*b*. At the forward ends of panels 13*a* and 13*b* are two outwardly extending flanges 130. The flanges 130 are inserted into the bolt casing 12 through nothes 123 of the casing 12 and engaged with flanges 122 of the casing 12. Each panel 13*a* or 13*b* is provided with screw holes 131 and 136 and two apertures 132 of figure-8 shape. A disengaging pin 14 is inserted in oblong pin holes 133 of the panels 13*a* and 13*b*. The top side of the panel 13*a* is provided with a top flange 134**.

Figure 3:
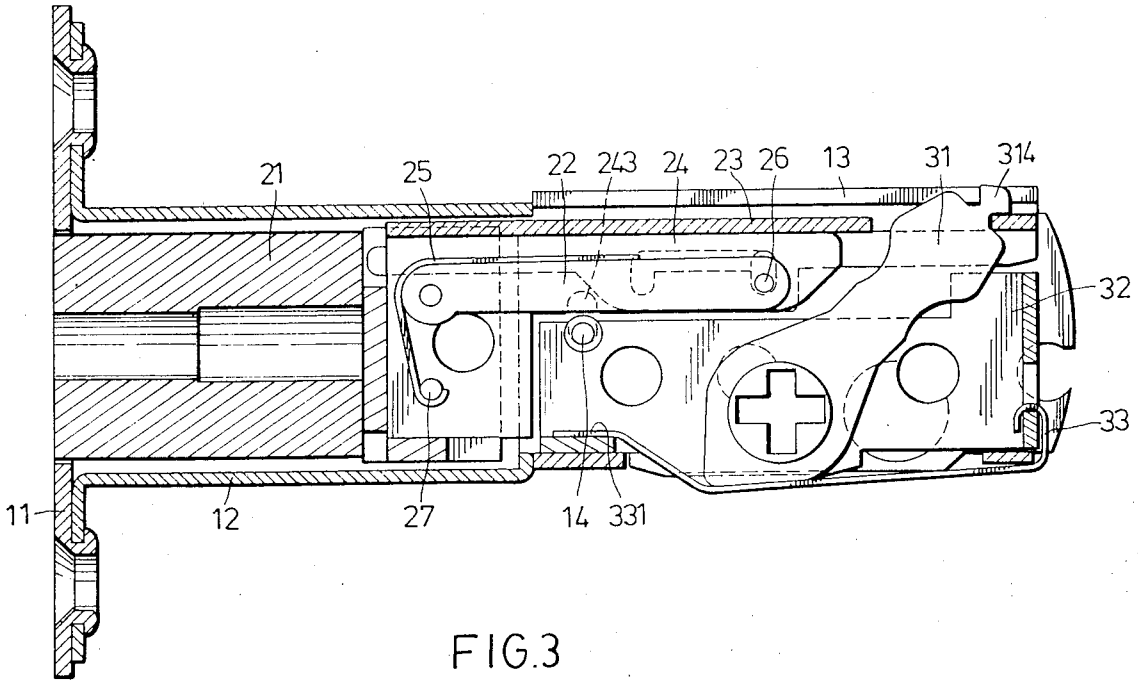
FIG. 3 is a sectional view of the dead bolt of FIG. 1 in which the extensible member is retracted.

The crank plate holding means 32 is mounted movably in the extension housing 13, and includes two parallel panels **32*a* and 32*b*, a rear panel 32*c* interconnecting panels 32*a* and 32*b*, and a web 325 projecting from the bottom sides of the panel 32*a*. As is better shown in FIG. 3, the panels 32*a* and 32*b* are supported by webs 13*c* of the extension housing 13. Attached to the crank plate holding means 32 is a spring 33 which has one end 331 abutting with the web 325 of the crank plate holding means 32 and extends to the bottom side of the rear web 13*c* through the open bottom of the crank plate holding means 32 and the extension housing 13. Hook end 332 of the spring 33 turns upward and hooks in a rear opening 324 of the rear panel 326. The crank plate holding means 32 can be secured to the extension housing 13 in a first position in which screw holes 321 and crank mounting hole 322 are aligned with screw hole 131, the lower side of front apertures 132 and the upper side of rear apertures 132, and a second position in which screw holes 321 and crank mounting hole 322 are aligned with the upper side of front aperture 132, the lower side of rear aperture 132 and screw holes 136. At the top sides of the panels 32***a* and 32*b* are provided curved notches 320 and 327 which can engage with the disengaging pin 14.

The adjustable bolt extension member 20 is connected to bolt 21 and mounted in the extension housing 13. It includes a fixed member 24 which is a plate member having flanges 241 and 245 and a circular boss 242, and an extensible member 23 which is disposed on and pivoted to the plate member 24 with a pivot pin 26 in such a manner that the extensible member 23 is movable in a longitudinal direction relative to the fixed member 24. The front portion of the fixed member 24 is inserted into a rear groove 210 of the bolt 21 and pivoted therein by means of pins 27 which pass through pin holes 240 of the fixed plate member 24 and through pin holes 211 of the bolt 21. The flanges 241 and 245 and the circular boss 242 engage with the grooved surfaces of the bolt 21, holding the fixed member 24 in the groove 210 in place.

The fixed plate member 24 is further provided with a curved notch 243 and a transverse oblong hole 244 through which the pivot pin 26 passes in such a manner that it can move upward and downward within a limited range. The extensible member 23 is a channel member having two longitudinal guide apertures 231 in its two sides and a top opening 230 in its top side 233. The top side 233 of the extensible channel member 23 is supported slideably by the top edge of the fixed plate member 24, and is retained in the extension housing 13 by the top flange 134 of the extension housing 13. The pin 26 also passes through the guide apertures 231, pivoting the extensible channel member 23 to the fixed plate 24. Each of the guide apertures 231 has two engaging portions 232 and permits the pivot pin 26 to move along the guide aperture so that the extensible channel member 23 can move between its extended position and its retracted position. The pin 26 is received in the front engaging portion 232 when the extensible channel member 23 is in the extended positin and is received in the rear engaging portions 232 when the channel member 23 is in the retracted position. Between the fixed plate 24 and one side of the extensible channel member 23 is a guide plate 22 which is pivoted to the fixed plate member 24 by means of upper pin 27 and pin 26 which rests on the disengaging pin 14. There is a bent spring 25 which abuts against the upper straight edge of the guide plate 22, passes over the front rounded edge of the guide plate 22 and then hooks to the lower pin 27 with its curved end 251. It can be noted that the disengaging pin 14 can be moved upward and downward in the pin holes 133 of the extension housing 13. When the disengaging pin 14 is moved upward, it disengages from the curved notches 320 or 327 and engages with a curved notch 243 of the fixed plate member 24, and at the same time lifts the guide plate 22 which in turn will move the pin 26 upward so that the pin 26 disengages from the engaging portion 232 of the guide aperture 231 and the extensible member is placed in an adjustable position. The adjusting operation will be detailed hereinafter. The spring 25 is used to return the guide plate 22 to its original position after the extensible channel member 23 is adjusted.

A crank plate 31 is mounted in the crank plate holding means 32. It is connected to a cylinder lock (not shown) through the holes 322 of the crank plate holding means 32 and apertures 132 of the extension housing 13 to transmit the actuation of the lock to the bolt assembly. The crank plate 31 is sandwiched between two panels 32*a* and 32*b* and has two circular bosses 311, at two sides, which are fitted snugly in holes 322 of the panels 32*a* and 32*b*. The upper portion 313 of the crank plate 31 has an engaging boss 314 at its top side, and extends into the opening 230 of the extensible channel member 23. When the lock is operated, the crank plate 31 turns about the axis of the holes 322, and the upper portion 313 of the crank plate 31 moves the extensible channel member 23 so that the bolt 21 is moved to a locking position or the releasing position. The edge 312 of the crank plate 31 is substantially of V-shape with a rounded apex and abuts against the spring plate 33 so that the crank plate 31 can always be retained in a predetermined angular position by the spring when it is turned forward or backward. The engaging boss 314 will engage with edge 234 or 235 of the extensible member 23 to hold the extensible member 23 in place when the crank plate 33 is turned forward or backward.

Figure 5:
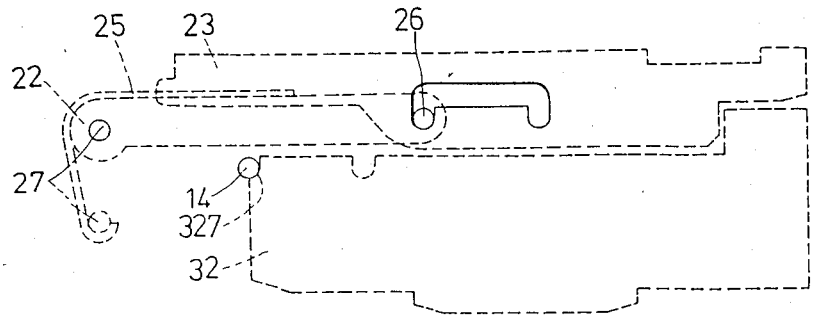
FIG. 5 is a schematic view showing the relationship between the extensible member, the guide plate and the crank plate holding means when the extensible member is extended.
Figure 4:
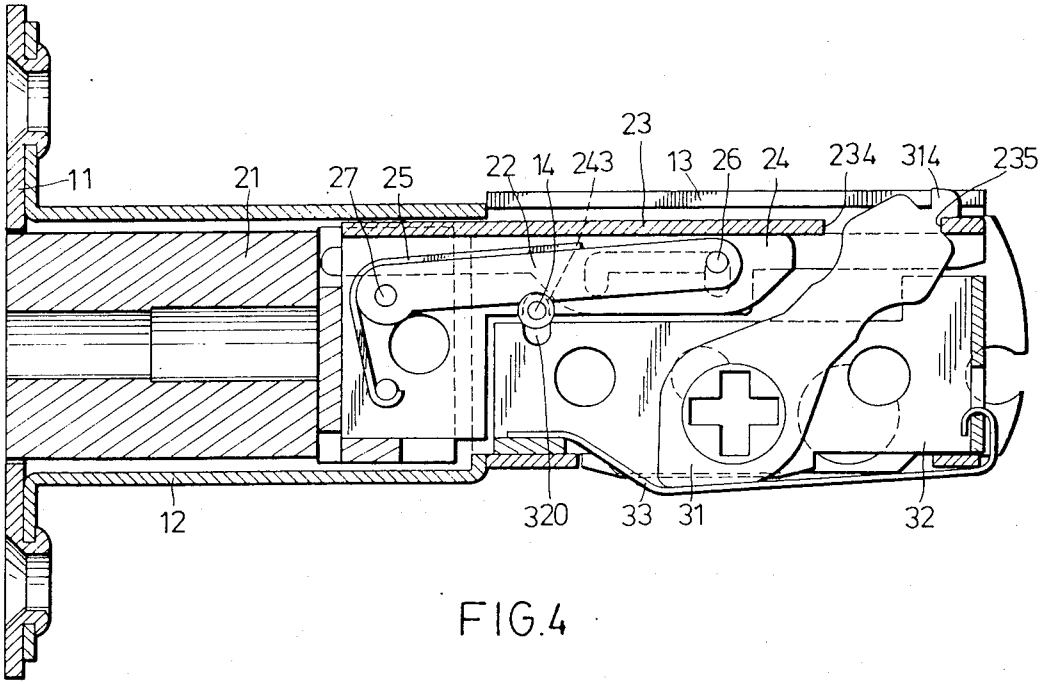
FIG. 4 is a sectional view of the dead bolt of FIG. 1 in which the extensible member is in the adjustable position.

The bolt assembly in this embodiment can be adjusted to two different lengths, i.e. 60 mm or 70 mm, by moving the extensible channel member 23 and the crank plate holding member 32 relative to the fixed plate member 24 and the extension housing 13 respectively. If a longer length of the bolt assembly is required, the disengaging pin 14 is moved upward by hand in the pin holes 133 to disengage from notches 320 of the crank plate holding means 32, as shown in FIG. 4. As the disengaging pin 14 is lifted, it is received in the notch 243 of the fixed plate member 24. Then, the crank plate holding means 32 is pulled backward to its second position in which holes 321 and 322 thereof are in alignment with apertures 132 and screw holes 136 of the extension casing 13. Similarly, the extensible channel member 23 moves backward relative to the fixed plate member 24 due to the movement of the crank plate 31 since the pin 26 is released from the rear engaging portion 232 of the guide aperture 231 of the extensible channel member 23. When the pin 26 reaches the front end of the guide aperture 231, the disengaging pin 14 is released and allowed to move downward by the action of the spring 25. In this situation, the disengaging pin 14 engages with notches 327 of the crank plate holding means 32, and the guide plate 22 is lowered so that the pin 26 is received in the front engaging portion 232 of the guide aperture 231, as shown schematically in FIG. 5. Finally, the crank plate holding means 32 is screwed to the extension casing 13 through aligned screw holes.

In case the bolt assembly is to be shortened, the extensible channel member 23 and the crank plate holding means 32 can be pushed forward by operating the disengaging pin 14 in the same manner as described above.

With the invention thus explained, it is apparent that various modifications and variations can be made without departing from the scope of the invention. It is therefore intended that the invention be limited as indicated in the appended claims.

What I claim is:

1. A dead bolt assembly for a lock including:

a bolt casing having a front mounting plate at its front side;

a bolt mounted movably in the bolt casing;

an extension housing fixed to the rear end of the bolt casing;

a crank plate mounted in the extension housing to be connected to the lock for transmitting the actuation of the lock to the bolt, the crank plate being turnable about an axis to move the bolt between a locking position and a releasing position; and an improvement which comprises:

an adjustable bolt extension member connected to the rear end of the bolt and housed in the extension housing, the bolt extension member including a fixed member fixed to the bolt and an extensible member pivoted movably to the fixed member and cooperating with the crank plate, one of the fixed member and the extensible member having a longitudinal guide aperture with a front and a rear engaging portion which is turned at an angle relative to the longitudinal aperture, and a pivot pin for pivoting the fixed member and the extensible member through the longitudinal guide aperture, the extensible member being movable between a first portion in which the pivot pin engages in the rear engaging portion and a second position in which the pivot pin engages in the front engaging portion;

means for disengaging the pivot pin from the front engaging portion or the rear engaging portion; and a crank plate holding means which is disposed in the extension housing and which can be positioned adjustably in the extension housing in a first position and a second position corresponding to the first position and the second position of the extensible member so that the crank plate can always be kept in a cooperative relationship with the extensible member.

2. A dead bolt assembly as claimed in claim 1, wherein the extension housing has a U-shaped cross-section, including two first parallel panels, and the crank plate holding means includes two second parallel panels disposed between the first parallel panels, and a rear panel interconnecting the second parallel panels, the second parallel panels sandwiching the crank plate in a movable position.

3. A dead bolt assembly as claimed in claim 2, wherein each of the first panels has an oblong pin hole aligned with the oblong pin hole of the other first panel, and each of the second panels has a front notch and a rear notch at its top edge, the front notch and the rear notch in each of the second panels being aligned with the front notch and the rear notch of the other second panel.

4. A dead bolt assembly as claimed in claim 3, wherein the disengaging means includes a transverse disengaging pin passing through the oblong pin holes of the first panels, the transverse disengaging pin engaging with the rear notches when the crank plate holding means is in the first position and with the front notches when the crank plate holding means is in the second position, the disengaging pin disengaging from the front notches or the rear notches to allow the crank plate holding means to move when it is lifted to the upper part of the oblong holes.

5. A dead bolt assembly as claimed in claim 4, wherein the fixed member of the bolt extension member is a plate having an oblong pivot hole through which the pivot pin passes and which allows the pivot pin to move upward and downward within a limited range.

6. A dead bolt assembly as claimed in claim 5, wherein the extensible member of the bolt extension member is a channel member having two parallel sides in which the longitudinal guide apertures are provided and a top side interconnecting the parallel sides, the top side being supported slideably by the top edge of the fixed member.

7. A dead bolt assembly as claimed in claim 6, wherein the top side of the extensible channel member has an engaging opening into which the upper portion of the crank plate extends and engages therewith.

8. A dead bolt assembly as claimed in claim 6, wherein the disengaging means further includes a longitudinal guide plate which is connected side by side to the fixed plate and which has a pin hole through which the pivot pin passes, the guide plate being placed on the transverse disengaging pin and capable of lifting the pivot pin to disengage from the front engaging portion or the rear engaging portion of the guide aperture when the disengaging pin is lifted.

* * * * *